United States Patent [19]

Jacquot

[11] Patent Number: 4,582,997

[45] Date of Patent: Apr. 15, 1986

[54] IONIC CURRENT REGULATING DEVICE

[75] Inventor: Bernard Jacquot, Saint Egreve, France

[73] Assignee: Commissariat a l'Energie Atomique, Paris, France

[21] Appl. No.: 659,315

[22] Filed: Oct. 10, 1984

[30] Foreign Application Priority Data

Oct. 17, 1983 [FR] France ..... 83 16465

[51] Int. Cl.[4] ..... H01J 27/00

[52] U.S. Cl. ..... 250/425; 250/423 R; 313/362.1; 315/111.81

[58] Field of Search ..... 250/291, 423 R, 425; 313/362.1; 315/111.81

[56] References Cited

U.S. PATENT DOCUMENTS

| | | | |
|---|---|---|---|
| 2,826,708 | 3/1958 | Foster et al. | 250/423 R |
| 3,792,251 | 2/1974 | Schmidt | 250/425 |
| 3,898,496 | 8/1975 | Hudson | 313/362.1 |
| 4,206,383 | 6/1980 | Amicich et al. | 313/362.1 |

FOREIGN PATENT DOCUMENTS

| | | |
|---|---|---|
| 2512623 | 11/1983 | France . |
| 2069230 | 8/1981 | United Kingdom . |

OTHER PUBLICATIONS

Revue de Physique Applique, vol. 15, No. 5, Mai 1980, Paris (FR.), R. Geller et al, pp. 995–1005, p. 1003, col. 1, lignes 14–22.

Nuclear Instruments and Methods in Physics Research, vol. 202, No. 3, Nov. 1982, Amsterdam (NL), R. Geller et al., pp. 399–401, p. 400, col. 2, lines 26–30; FIGS. 4–6.

*Primary Examiner*—Bruce C. Anderson

[57] ABSTRACT

The invention relates to a device for regulating an ionic current, particularly a highly charged metal ion current, obtained by vaporizing and then ionizing a solid material in an ultra-high frequency cavity with the aid of a hot electron plasma confined in said cavity. This plasma is produced by ionizing a gas as a result of the combined action of a high frequency electromagnetic field and a magnetic field, whose amplitude is such that the electron cyclotron resonance is satisfied. The device inter alia comprises a pulse generator, whereof the useful cycle is regulated in order to pulse the electromagnetic field and control its mean power, a valve for modifying the gas flow entering the cavity and means for controlling said valve in such a way that the pressure prevailing in the cavity remains constant.

10 Claims, 2 Drawing Figures

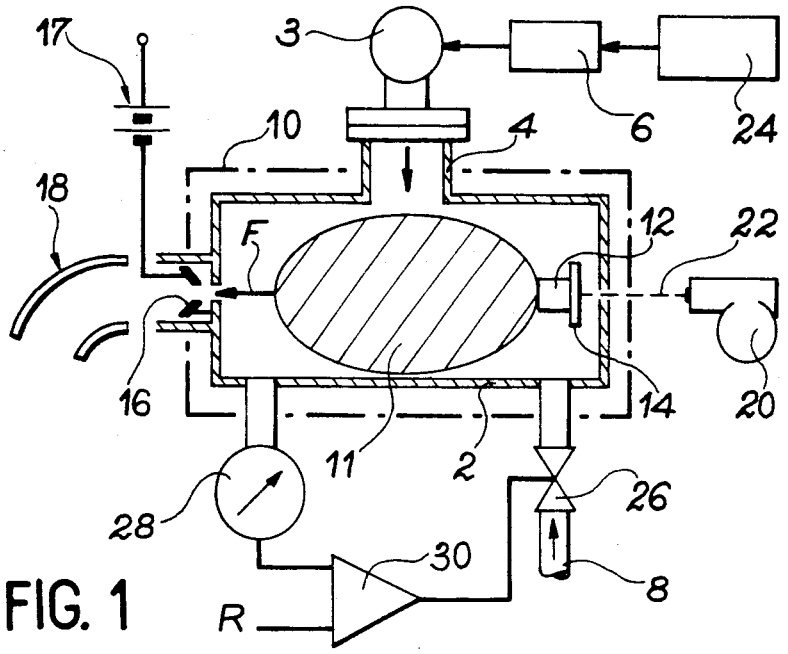
FIG. 1
FIG. 2
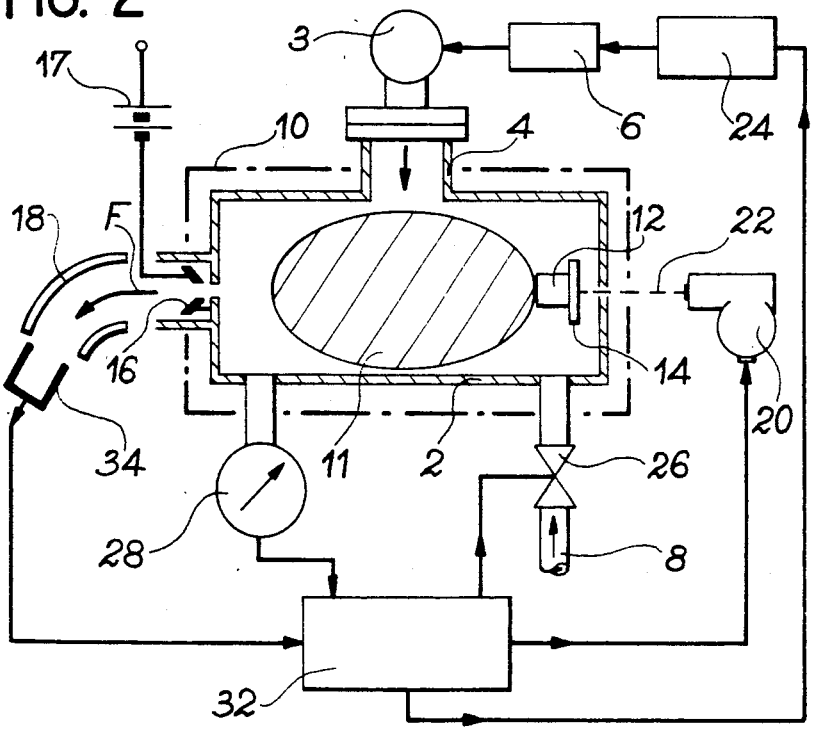

IONIC CURRENT REGULATING DEVICE

BACKGROUND OF THE INVENTION

The present invention relates to a device for regulating an ionic current or ion stream, particularly highly charged metal ions. This highly charged ion stream is more particularly used for measuring physical constants and particularly for equipping particle accelerators, used both in the scientific and medical fields.

One of the processes used for obtaining a highly charged or multicharged ion stream or ionic current consists of evaporating a solid material, e.g. a metal sample placed in an ultra-high frequency cavity and then ionizing the vapours produced.

The vaporization and then the ionization of the material are obtained by the interaction of a hot plasma of electrons, confined in said enclosure, with said material. This electron plasma is formed by ionizing a gas, injected into the cavity, as a result of the combined action of a high frequency electromagnetic field established in said cavity and a magnetic field prevailing within the same cavity. The magnetic field has an amplitude B satisfying the electron cyclotron resonance condition $B=f\cdot 2\pi(m/e)$, in which m is the mass of the electron, e its charge and f the electromagnetic field frequency. This resonance makes it possible to highly accelerate the electrons produced, firstly from the gas and then from the vaporization of the material.

This vaporization process was described in French patent application No. 2,512,623, filed on Sept. 10th, 1981 by the present Applicant and entitled "Process for the fusion and/or pulsed evaporation of a solid material". The metal ions produced can then be extracted from the cavity to form an ion beam.

In such a multicharged ion stream production process, one of the major problems is that of regulating the ion stream, i.e. in obtaining a constant intensity ion stream. This is very important, particularly when these ion streams are used in particle accelerators.

SUMMARY OF THE INVENTION

The present invention relates to an ion stream regulating device making it possible to solve this problem.

More specifically, the present invention relates to a device for regulating an ion stream or ionic current, particularly highly charged metal ions, obtained according to the evaporation process described hereinbefore. According to one of the features of the invention, this device comprises means for pulsating the electromagnetic field injected into the cavity and for checking the mean power of said electromagnetic field. These means are preferably constituted by a high frequency pulse generator, whereof the useful cycle is regulated, i.e. the ratio t/T, t being the duration of one pulse and T the period of the pulses.

According to a preferred embodiment of the device according to the invention, the pulse generator is controlled in such a way that the ionic current intensity remains constant. These control means preferably comprise means for measuring the intensity of the ionic current connected to a microprocessor.

According to another feature of the invention, the regulating device comprises a valve, which modified the gas flux introduced into the cavity and means making it possible to control said valve in such a way that the pressure in the cavity remains constant.

According to a preferred embodiment of the device according to the invention, the device for controlling the valve is constituted by pressure measuring means connected to a microprocessor.

According to another feature of the invention, the regulating device comprises means making it possible to slowly displace the solid material within the cavity, in such a way that there is optimum interception by the solid material of the electron plasma.

According to a preferred embodiment of the device according to the invention, the displacement means are controlled in such a way that the intensity of the ionic current is constant. These control means are preferably constituted by means for measuring the intensity of the ionic current connected to a microprocessor.

Advantageously, the gas introduced into the cavity is constituted by argon, nitrogen or oxygen. This type of gas is particularly suitable for obtaining metal ions resulting from the vaporization of refractory metals, such as tungsten, tantalum, molybdenum, zirconium, etc.

BRIEF DESCRIPTION OF THE DRAWINGS

The invention is described in greater detail hereinafter relative to non-limitative embodiments and the attached drawings, wherein show:

FIG. 1 diagrammatically and according to a first variant, a manual device for regulating the ionic current obtained according to the material vaporization process.

FIG. 2 diagrammatically and according to a second variant, a device for automatically regulating an ionic current obtained according to the metal vaporization process.

DETAILED DESCRIPTION OF THE PREFERRED EMBODIMENTS

With reference to FIGS. 1 and 2, a description will firstly be given of the apparatus making it possible to produce the highly charged ionic current or ion stream. The apparatus comprises a confinement vacuum enclosure constituting a resonant cavity, which can be excited by an ultra-high frequency electromagnetic valve which, according to the invention, is pulsed. This electromagnetic field produced by a source 3, such as a klystron, is introduced into the cavity by means of a waveguide 4 having a circular or rectangular section. This source 3 is supplied with power by a power supply 6. A pipe 8 makes it possible to introduce a gas into the ultra-high frequency cavity 2, the gas being e.g. argon, nitrogen or oxygen.

Means, diagrammatically indicated by broken lines and carrying the reference numeral 10, make it possible to produce a magnetic field prevailing within cavity 2. This magnetic field has an amplitude satisfying the electron cyclotron resonance condition explained hereinbefore. This means making it possible to produce such a magnetic field can be in accordance with French patent application No. 2,475,798, filed on Feb. 13th, 1980 by the present Applicant and entitled "Process and apparatus for producing highly charged large ions and an application utilizing the process".

The association of the electromagnetic field and the magnetic field makes it possible to highly ionize the gas introduced into cavity 2. The electrons produced are then highly accelerated by electron cyclotron resonance, which leads to the formation of a hot electron plasma confined within the cavity. The electron plasma confinement space is indicated by a hatched ellipse 11.

The cavity 2 contains a sample 12 from which the ion stream will be produced. This sample, fixed to a support 14, is particularly a sample of a metal, such as e.g. tungsten, tantalum, molybdenum, zirconium, etc. This sample is subject to the action of the hot electron plasma 11, which makes it possible to vaporize it and then ionize the vapors produced. The metal ions formed are then extracted from cavity 2, e.g. using electrodes 16 between which is produced a negative potential difference with the aid of a power supply 17. The ions from the cavity (arrow F) are then analyzed, e.g. selected in accordance with their degree of ionization, with the aid of any known means 18, using an electrical and/or magnetic field.

A description will now be provided of the device according to the invention, which makes it possible to regulate the stream of ions produced, i.e. makes it possible to obtain a constant intensity ionic current.

This device comprises a motor 20, connected via a rod 22 to the support 14 for sample 12 making it possible to slowly displace the latter, so that it intercepts in the optimum manner the electron plasma 11. The more sample 20 penetrates the cavity 2, the higher its temperature and consequently the higher its vaporization level.

Moreover, the vaporization level and consequently the ionization of the in particular metal vapours are dependent on the means power of the pulsed electromagnetic field injected into cavity 2 for a given depth of penetration of the sample into the electron plasma. For example, in order to obtain aluminium ions charged 10 times (with an aluminium oxide sample, the support gas being oxygen), it is necessary to use an electromagnetic field having a power at least equal to 300 Watts.

The mean power of the electromagnetic field is controlled by pulsating the electromagnetic field. This pulsed field can be obtained with the aid of a pulse generator 24, whereof the useful cycle is adjusted, i.e. the ratio t/T, t being the duration of a pulse and T the period of the pulses, said generator controlling the electric power supply 6 supplying the electromagnetic wave source 3. Thus, the electrons of the plasma acquire the energy necessary for evaporating sample 12 and then for ionizing the vapours produced as from the application of the ultra-high frequency electromagnetic field and loose said energy almost immediately after said field has disappeared.

As has been stated hereinbefore, the hot electron plasma is firstly obtained by an ionization of a gas, particularly argon, nitrogen or oxygen, introduced into cavity 2 by a pipe 8. This gas permits the formation of the plasma before the partial pressure of the metal vapours is adequate to produce the metal ions.

In order to regulate the ionic current from the cavity (arrow F), the total pressure in the cavity must be kept constant. To this end, the gas supply pipe 8 is equipped with a valve 26 used for modifying the gas flow introduced into the cavity. A device 28 for measuring the total pressure in cavity 2, such as a pressure gauge makes it possible, via a suitable device, to ensure the operation of valve 26 in such a way that the total pressure in the cavity remains constant.

As shown in FIG. 1, this appropriate device can be constituted by a device 30, connected to a reference voltage R, making it possible to compare the voltage supplied by the measuring device 28 and the reference voltage R and to supply a control signal to valve 26. This signal corresponds to the voltage difference between the voltage supplied by the measuring device 28 and the reference voltage R.

As illustrated in FIG. 2, this appropriate device can also comprise a microprocessor 32 controlling the opening or closing of valve 26 in accordance with the voltage supplied by measuring device 28. For example, this microprocessor is MOTOROLA type 6800.

Moreover, the starting up of motor 20 for displacing the sample 12 and that of the pulse generator 24 for producing the pulsed electromagnetic field can be carried out manually, as shown in FIG. 1, or automatically, as shown in FIG. 2. In the second case, the device 24 for measuring the intensity of the ionic current from cavity 2, such as a Faraday cage must be provided. The signal supplied by device 34 is introduced into microprocessor 32 controlling the starting up or stopping of on the one hand motor 20 and on the other the pulse generator 24.

The drive motor 20 and the pulse generator 24 dependent on the intensity of the ionic current, as well as the valve 26 controlled in such a way that the total pressure prevailing in the enclosure is constant, constitute, according to the invention, a device making it possible to obtain an ionic current, particularly a constant intensity metal ion current.

What is claimed is:

1. A device for regulating a highly charged ionic current, obtained by vaporizing a solid material in an ultra-high frequency cavity and then ionizing the vapors produced as a result of the action of a hot electron plasma confined in said cavity, said plasma being produced by ionizing a gas introduced into the cavity as a result of the combined action of a high frequency electromagnetic field, established in the cavity, and a magnetic field, whose amplitude is such that the electrons are accelerated by electron cyclotron resonance, wherein the device comprises means making it possible to pulse the electromagnetic field injected into the cavity and control the mean power of this field.

2. A regulating device according to claim 1, wherein the means for pulsing and controlling the electromagnetic field comprise a pulse generator, whose useful cycle is regulated.

3. A regulating device according to claim 2, wherein it comprises means for controlling the pulse generator, in such a way that the ionic current intensity is constant.

4. A regulating device according to claim 3, wherein the means for controlling the generator comprise means for measuring the intensity of the ionic current connected to a microprocessor.

5. A regulating device according to claim 1, wherein it comprises a valve for modifying the gas flow introduced into the cavity and means for controlling the valve in such a way that the pressure in the cavity remains constant.

6. A regulating device according to claim 5, wherein the means for controlling the valve comprise pressure measuring means connected to a microprocessor.

7. A regulating device according to claim 1, wherein it comprises means for slowly displacing the solid material in the cavity, so that said material intercepts the electron plasma in the optimum manner.

8. A regulating device according to claim 7, wherein it comprises means for controlling the displacement means, in such a way that the ionic current intensity is constant.

9. A regulating device according to claim 8, wherein the means for controlling the displacement means comprise means for measuring the intensity of the ionic current connected to a microprocessor.

10. A regulating device according to claim 1, wherein the gas introduced into the cavity is argon, nitrogen or oxygen.

* * * * *